US012133603B2

(12) United States Patent
Soderberg

(10) Patent No.: US 12,133,603 B2
(45) Date of Patent: Nov. 5, 2024

(54) SYSTEMS AND METHODS FOR PROVIDING SECURE ACCESS TO A RECEPTACLE

(71) Applicant: GMI Holdings, Inc., Mt. Hope, OH (US)

(72) Inventor: Mark Soderberg, Conifer, CO (US)

(73) Assignee: GMI Holdings, Inc., Mount Hope, OH (US)

( * ) Notice: Subject to any disclaimer, the term of this patent is extended or adjusted under 35 U.S.C. 154(b) by 161 days.

(21) Appl. No.: 17/727,403

(22) Filed: Apr. 22, 2022

(65) Prior Publication Data

US 2022/0338658 A1 Oct. 27, 2022

Related U.S. Application Data

(60) Provisional application No. 63/179,146, filed on Apr. 23, 2021.

(51) Int. Cl.
*A47G 29/14* (2006.01)

(52) U.S. Cl.
CPC ..... *A47G 29/141* (2013.01); *A47G 2029/145* (2013.01); *A47G 2029/149* (2013.01)

(58) Field of Classification Search
CPC ..... A47G 29/141; A47G 2029/145; A47G 2029/149; E05B 45/06; G07C 9/00
USPC ..... 340/5.73
See application file for complete search history.

(56) References Cited

U.S. PATENT DOCUMENTS 1,186,565 A 6/1916 Fogg
5,078,096 A 1/1992 Bishop
5,161,328 A 11/1992 Traue
5,774,053 A 6/1998 Porter
5,979,750 A 11/1999 Kindell
6,300,873 B1 10/2001 Kucharczyk
6,967,575 B1 11/2005 Dohrmann
6,987,452 B2 1/2006 Yang
7,341,186 B2 * 3/2008 Mrozik ..... G06Q 10/08 235/384
7,815,112 B2 10/2010 Volpe
9,244,147 B1 * 1/2016 Soundararajan ..... G01S 1/44
(Continued)

FOREIGN PATENT DOCUMENTS

AU 2013100961 A4 8/2013
AU 2014100457 A4 6/2014
(Continued)

*Primary Examiner* — Nam V Nguyen
(74) *Attorney, Agent, or Firm* — Haynes and Boone, LLP

(57) ABSTRACT

A method includes: receiving an authentication message from a delivery driver device including information associated with a parcel identifier; comparing the information to one or more stored codes; sending, in response to determining a match, an unlock instruction signal to a lock mechanism; and wirelessly transmitting an acknowledgement message to the driver device. A parcel receptacle includes a compartment, a lid, a lock mechanism, a wireless communication module, and a controller. The controller is configured to: receive an authentication message from a delivery driver device including a parcel identifier; compare the parcel identifier to one or more stored codes; send an unlock instruction signal to the lock mechanism in response to determining the parcel identifier matches a stored code; and transmit an error message to the driver device.

20 Claims, 6 Drawing Sheets

(56) References Cited

U.S. PATENT DOCUMENTS

| | | | | |
|---|---|---|---|---|
| 9,418,495 | B2 | 8/2016 | Mackin | |
| 9,608,834 | B2 | 3/2017 | Hall | |
| 9,661,123 | B1 | 5/2017 | Hall | |
| 9,667,768 | B1 | 5/2017 | Hall | |
| 9,712,335 | B2 | 7/2017 | Hall | |
| 9,811,958 | B1 | 11/2017 | Hall | |
| 9,861,221 | B2 | 1/2018 | Jiang | |
| 9,967,151 | B2 | 5/2018 | Hall | |
| 10,039,401 | B1 | 8/2018 | Romanucci | |
| 10,314,424 | B2 | 6/2019 | Geng | |
| 10,362,889 | B2 | 7/2019 | Dehner | |
| 10,445,687 | B2 | 10/2019 | Levy | |
| 10,638,848 | B1 | 5/2020 | Wesley | |
| 10,653,262 | B1 | 5/2020 | Isreal | |
| 10,743,694 | B2 | 8/2020 | Raphael | |
| 10,772,450 | B2 | 9/2020 | Waisanen | |
| 10,812,626 | B2 | 10/2020 | Hall | |
| 10,827,868 | B1 | 11/2020 | Wheaton | |
| 10,881,235 | B1 | 1/2021 | Vasquez | |
| 10,898,021 | B2 | 1/2021 | Rampton | |
| 10,954,068 | B2 | 3/2021 | Nevison | |
| 11,033,137 | B2 | 6/2021 | Geng | |
| 11,064,832 | B1 | 7/2021 | Goldstein | |
| 11,131,138 | B2 | 9/2021 | Wei | |
| 11,202,526 | B2 | 12/2021 | Juhasz | |
| 11,250,652 | B2 | 2/2022 | Sengstaken, Jr. | |
| 11,319,745 | B1 | 5/2022 | Tobias | |
| 11,410,221 | B2 * | 8/2022 | Zundel | G06Q 10/0833 |
| 11,587,020 | B2 * | 2/2023 | Robinson | G06Q 40/02 |
| 2001/0050615 | A1 | 12/2001 | Kucharczyk | |
| 2002/0005774 | A1 | 1/2002 | Rudolph | |
| 2002/0089434 | A1 | 7/2002 | Ghazarian | |
| 2002/0180580 | A1 | 12/2002 | Gotfried | |
| 2003/0231112 | A1 * | 12/2003 | Raju | G07C 9/27 340/569 |
| 2004/0238615 | A1 | 12/2004 | Offenbacher | |
| 2005/0104716 | A1 * | 5/2005 | Simms | G07C 9/27 340/5.73 |
| 2006/0020489 | A1 | 1/2006 | Rivalto | |
| 2006/0119471 | A1 | 6/2006 | Rudolph | |
| 2006/0122852 | A1 | 6/2006 | Moudy | |
| 2006/0208852 | A1 | 9/2006 | Wenzlik | |
| 2006/0214770 | A1 | 9/2006 | Capouch | |
| 2007/0247276 | A1 | 10/2007 | Murchison | |
| 2008/0136908 | A1 | 6/2008 | Carter | |
| 2011/0014863 | A1 | 1/2011 | Foster | |
| 2011/0248818 | A1 | 10/2011 | Hashim-Waris | |
| 2012/0158606 | A1 | 6/2012 | Moudy | |
| 2013/0144428 | A1 * | 6/2013 | Irwin | G07F 17/10 700/218 |
| 2014/0068247 | A1 | 3/2014 | Davis | |
| 2014/0090299 | A1 | 4/2014 | Brown | |
| 2014/0190081 | A1 | 7/2014 | Wanjohi | |
| 2014/0367306 | A1 | 12/2014 | Normandin | |
| 2015/0120529 | A1 | 4/2015 | Faaborg | |
| 2015/0120602 | A1 * | 4/2015 | Huffman | G06Q 10/083 700/214 |
| 2015/0186840 | A1 | 7/2015 | Torres | |
| 2015/0199857 | A1 | 7/2015 | Mackin | |
| 2015/0235173 | A1 | 8/2015 | Hall | |
| 2015/0320209 | A1 | 11/2015 | Hasselback | |
| 2015/0371468 | A1 | 12/2015 | Mackin | |
| 2016/0050082 | A1 | 2/2016 | Hall | |
| 2016/0066733 | A1 | 3/2016 | Gozar | |
| 2016/0098678 | A1 | 4/2016 | Levy | |
| 2016/0171435 | A1 | 6/2016 | Newton | |
| 2016/0335595 | A1 | 11/2016 | Levy | |
| 2017/0124510 | A1 * | 5/2017 | Caterino | A47G 29/141 |
| 2018/0108192 | A1 | 4/2018 | Ho | |
| 2018/0130159 | A1 | 5/2018 | High | |
| 2018/0367419 | A1 | 12/2018 | Hall | |
| 2019/0244460 | A1 | 8/2019 | Kaneko | |
| 2019/0244461 | A1 | 8/2019 | Nandakumar | |
| 2019/0313826 | A1 | 10/2019 | Bickford | |

FOREIGN PATENT DOCUMENTS

| | | | |
|---|---|---|---|
| BE | 1013597 | A3 | 4/2002 |
| CN | 103711411 | A | 4/2014 |
| GB | 2362924 | A | 12/2001 |
| GB | 2394509 | A | 4/2004 |
| JP | 4399289 | B2 | 1/2010 |
| KR | 101024620 | B1 | 3/2011 |
| KR | 20110039414 | A | 4/2011 |
| WO | 2013158568 | A1 | 10/2013 |
| WO | 2021256988 | A1 | 12/2021 |

* cited by examiner

SYSTEMS AND METHODS FOR PROVIDING SECURE ACCESS TO A RECEPTACLE

CROSS REFERENCE TO RELATED APPLICATIONS

This application claims the benefit of and priority to U.S. Provisional Application No. 63/179,146, filed Apr. 23, 2021, entitled "Systems and Methods for Providing Secure Access to a Receptacle," which is hereby incorporated by reference in its entirety.

TECHNICAL FIELD

This disclosure is generally directed to secure access control of lockable storage containers or enclosures for receiving and securing articles. In some examples, such an enclosure may include a parcel receptacle.

BACKGROUND

Package theft has become a common problem. The volume of online ordering via websites and mobile applications has increased substantially in recent years. In one study published in 2020, it was reported that, of respondents that had placed at least one online order in the previous 12 months, 59% receive some type of package delivery on a weekly basis. Concerningly, 43% of respondents indicated that they have had a package stolen.

Consumers have attempted to reduce package thefts in a variety of ways such as scheduling deliveries for times when they are home, installing video doorbells, requesting that drivers attempt to conceal packages, and so on.

Some products have been marketed as package vaults, which are lockable containers for securing packages, groceries, and other delivered goods.

Delivery personnel have identified concern with the time required to utilize these containers. Some delivery drivers may be making 200 or more daily stops and, as such, even seconds of additional time associated with accessing lockable containers to complete deliveries may aggregate into a substantial delay over the course of the day, leading to extended working hours or reduced delivery capacity. Some lockable containers require a package delivery label to be scanned using an included barcode scanner. The result of the scan is transmitted via a local Internet connection, remotely authenticated, and a return message is received to permit access to the container. Not only can this procedure introduce delay into the delivery, but a communications outage can prevent access altogether. Other containers utilize a keypad and require the delivery driver to manually enter a code to gain access. These access control processes can consume valuable time for the delivery driver.

Accordingly, a need exists for an improved parcel delivery system that expedites delivery while providing secure storage.

SUMMARY

To expedite delivery, the present disclosure contemplates a parcel delivery system utilizing a lockable parcel receptacle in which Internet access is not required at the time of delivery of a parcel Tracking numbers or order numbers of expected deliveries may be preloaded in memory of a controller of the receptacle in advance of delivery.

Carrier delivery personnel including postal workers and parcel delivery drivers for carriers such as UPS, FedEx, DHL, Amazon, and others, may collectively be referred to herein as "drivers." Drivers typically use a handheld device which may be a specialized rugged device or a smartphone or a tablet with built in components such as a barcode scanner, a GPS module, an Internet data connection (e.g., cellular), a touchscreen or other user interface, and wireless communication modules utilizing Wi-Fi, Bluetooth, or other wireless protocols. These devices may be referred to herein collectively as "driver devices" or "mobile devices."

Driver devices may provide turn-by-turn navigational guidance or maps. Driver devices may be loaded daily with information associated with parcel deliveries scheduled for a particular day. At each stop, the driver may retrieve the one or more parcels for delivery and scan a parcel label to communicate to a server information about the delivery, such as the time, date, tracking code, GPS location, and/or a photograph of the delivered parcel to verify and record that delivery has occurred. The systems and methods described herein allow for placement of a parcel into a lockable parcel receptacle without causing meaningful delay to the driver's schedule.

Systems and methods described herein facilitate formulating or generating a wireless transmission upon scanning a parcel label. The wireless transmission may be sent locally without requiring network access. The transmission protocol preferably is low energy, such as Bluetooth low energy (BLE). The wireless transmission may include an identifier such as a tracking number, order number, or any other information suitable for transmission to and authentication by the parcel receptacle. In some examples, the identifier may be the only information transmitted to the parcel receptacle. In some examples, the transmission may include information such as package data (e.g., recipient, sender, dimensions, weight, contents, etc.), time data, driver data (e.g., employee number or unique identification number of driver device), or the like. The wireless transmission is received by wireless receiver or transceiver on the parcel receptacle for authentication. Authentication may include comparison with expected delivery identifiers already stored on a local or remote memory device. The authentication by the parcel receptacle controller, or a remote controller, if successful results in unlocking of the container.

In addition to expediting access authentication for deliveries, the systems and methods described herein may also provide an alternate mechanism for satisfying recipient signatures related to delivery confirmation for the shipping vendor and/or waiver of liability for the carrier. Prior to a delivery, a user may be informed of a signature requirement associated with a parcel. The user may access a mobile application of the lockable receptacle system an select an option to satisfy signature requirements without physically signing for the parcel. In some examples, the user may select an option to authorize a "waiver of liability" which may result in displaying a waiver indication on a display screen of the parcel receptacle or to transmit a waiver indication wirelessly to the driver device.

Consistent with some examples, a method may include receiving a parcel identifier from a sensor, transmitting a reporting message to a remote server, and transmitting an authentication message to a local wireless receiver. The reporting message may include first information associated with the parcel identifier and the authentication message may include second information associated with the parcel identifier.

In some examples, the sensor may include an optical scanner configured to interpret a barcode or a quick response code. The remote server may be part of a carrier platform and the reporting message may be configured to provide confirmation of delivery information to the carrier platform. The first information associated with the parcel identifier and the second information associated with the parcel identifier may be the same or different. The first information associated with the parcel identifier and the second information associated with the parcel identifier may include a carrier tracking number. Transmitting the reporting message and transmitting the authentication message may be performed automatically in response to receipt of the parcel identifier.

In some examples, a method may include receiving a reply message from a transmitter associated with the local receiver, determining whether the reply message includes an error report or an acknowledgement, and displaying an alternate delivery message on a display based on determining the reply message includes an error report or displaying an authentication confirmation message on the display based on determining the reply message includes an acknowledgement.

In some examples, a method may include determining whether a signature requirement is associated with the parcel identifier, displaying a completion message on a display based on determining the signature requirement is not associated with the parcel identifier, determining whether the signature requirement has been satisfied based on determining the signature requirement is associated with the parcel identifier, and based on determining the signature requirement has not been satisfied, transmitting a signature request to the local wireless receiver or displaying a signature requirement message on the display.

In some examples, a reporting message may be transmitted using a first wireless communication protocol and an authentication message may be transmitted using a second wireless communication protocol different than the first wireless communication protocol. The first wireless communication protocol may include a cellular data protocol and the second wireless communication protocol may include a Bluetooth data protocol.

Consistent with some examples, a method may include receiving an authentication message transmitted wirelessly which includes information associated with a parcel identifier, comparing the information associated with the parcel identifier to one or more stored codes in an active code list, and sending an unlock instruction signal to a lock mechanism in response to determining the information associated with the parcel identifier matches at least one of the one or more stored codes.

In some examples, a method may include wirelessly transmitting an acknowledgement message in response to determining the information associated with the parcel identifier matches at least one of the one or more stored codes. In some examples, a method may include wirelessly transmitting an error message in response to determining the information associated with the parcel identifier does not match at least one of the one or more stored codes. A method may include removing the one or more stored codes from the active code list based on determining the information associated with the parcel identifier matches at least one of the one or more stored codes.

In some examples, a method may include determining a signature requirement is associated with the parcel identifier and wirelessly transmitting a signature message. Determining a signature requirement is associated with the parcel identifier may include receiving a signature request message.

In some examples, a method may include detecting completion of delivery of a parcel and sending, in response to the detecting, a lock instruction signal to the lock mechanisms. In some examples, a method may include detecting a lid of a parcel receptacle has been closed. Detecting the completion of the delivery of the parcel may be based at least in part on detecting the lid has been closed. Detecting the completion of the delivery of the parcel may be based on signals received from one or more sensors disposed within a compartment of a parcel receptacle.

In some examples, a method may include transmitting a delivery reporting message configured to notify a user that a parcel associated with the parcel identifier has been delivered.

Consistent with some examples, a hand-held delivery driver device may include a sensor, a wireless communication module, and a controller. The controller may be configured to receive a parcel identifier from the sensor, instruct the wireless communication module to transmit a reporting message to a remote server in response to receipt of the parcel identifier, and instruct the wireless communication module to transmit an authentication message to a parcel receptacle in response to receipt of the parcel identifier.

In some examples, the sensor may include an optical scanner configured to interpret a barcode or a quick response code. The controller may be configured to instruct the wireless communication module to transmit the reporting message and to transmit the authentication message automatically in response to receipt of the parcel identifier.

In some examples, the controller may be further configured to determine a signature requirement is associated with the parcel identifier and instruct the wireless communication module to transmit a signature request to the parcel receptacle.

In some examples, the wireless communication module may be configured to transmit the reporting message using a first wireless communication protocol and to transmit the authentication message using a second wireless communication protocol different than the first wireless communication protocol. The first wireless communication protocol may include a cellular data protocol and the second wireless communication protocol may include a Bluetooth data protocol.

Consistent with some examples, a parcel receptacle includes a compartment, a lid, a lock mechanism, a wireless communication module, and a controller. The lid may have a closed position preventing access into the compartment and an open position. The lock mechanism may be configured to selectively secure the lid in the closed position. The controller may be configured to receive an authentication message including a parcel identifier via the wireless communication module, compare the parcel identifier to one or more stored codes in an active code list, and send an unlock instruction signal to the lock mechanism in response to determining the parcel identifier matches at least one of the one or more stored codes.

In some examples, the controller may be further configured to instruct the wireless communication module to transmit an acknowledgement message in response to determining the parcel identifier matches at least one of the one or more stored codes. The controller may be further configured to instruct the wireless communication module to transmit an error message in response to determining the parcel identifier does not match at least one of the one or more stored codes. The controller may be further configured to remove the one or more stored codes from the active code list based on determining the parcel identifier matches at least one of the one or more stored codes. The controller may be further configured to determine a signature requirement is associated with the parcel identifier and instruct the wireless communication module to transmit a signature message.

In some examples, determining a signature requirement is associated with the parcel identifier may include receiving a signature request message. The controller may be further configured to detect completion of delivery of a parcel and send a lock instruction signal to the lock mechanism in response to the detecting. The controller may be further configured to detect the lid has been closed. The detecting the completion of the delivery of the parcel may be based at least in part on detecting the lid has been closed. A parcel receptacle may include one or more sensors disposed in the compartment. Detecting the completion of the delivery of the parcel is based on signals received from the one or more sensors. The one or more sensors may include at least one of a force sensor disposed on a floor of the compartment, an optical sensor, a light curtain sensor, or a lock mechanism actuation sensor.

Consistent with some examples, a parcel receptacle may include a compartment, a lid, a lock mechanism, a wireless communication module, and a controller. The lid may have a closed position preventing access into the compartment and an open position. The lock mechanism may be configured to selectively secure the lid in the closed position. The controller may be configured to instruct the wireless communication module to periodically transmit a beacon signal, receive an authentication message including a parcel identifier from a delivery driver device, compare the parcel identifier to one or more stored codes in an active code list, and send an unlock instruction signal to the lock mechanism in response to determining the parcel identifier matches at least one of the one or more stored codes.

In some examples, the beacon signal may include a customer identifier associated with the parcel receptacle.

Consistent with some examples, a hand-held delivery driver device may include a wireless communication module and a controller. The controller may be configured to receive a beacon signal including a customer identifier from a parcel receptacle via the wireless communication module, retrieve one or more parcel identifiers associated with the customer identifier in response to receipt of the beacon signal, and instruct the wireless communication module to transmit an authentication message including at least one of the one or more parcel identifiers to the parcel receptacle.

Consistent with some examples, a parcel receptacle may include a compartment, a lid, a lock mechanism, a wireless communication module, and a controller. The lid may have a closed position preventing access into the compartment and an open position. The lock mechanism may be configured to selectively secure the lid in the closed position. The controller may be configured to receive a beacon signal from the wireless communication module, instruct the wireless communication module to transmit a customer identifier to a delivery driver device in response to receipt of the beacon signal, receive an authentication message including a parcel identifier from the delivery driver device, compare the parcel identifier to one or more stored codes in an active code list, and send an unlock instruction signal to the lock mechanism in response to determining the parcel identifier matches at least one of the one or more stored codes.

Consistent with some examples, a hand-held delivery driver device includes a wireless communication module and a controller. The controller may be configured to instruct the wireless communication module to periodically transmit a beacon signal, receive a customer identifier transmitted by a parcel receptacle in response to receipt of the beacon signal, retrieve one or more parcel identifiers associated with the customer identifier in response to receipt of the customer identifier, and instruct the wireless communication module to transmit an authentication message to the parcel receptacle. The authentication message may include at least one of the one or more parcel identifiers.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

BRIEF DESCRIPTION OF THE DRAWINGS

The accompanying drawings illustrate implementations of the systems, devices, and methods disclosed herein and together with the description, serve to explain the principles of the present disclosure.

Figure 1:
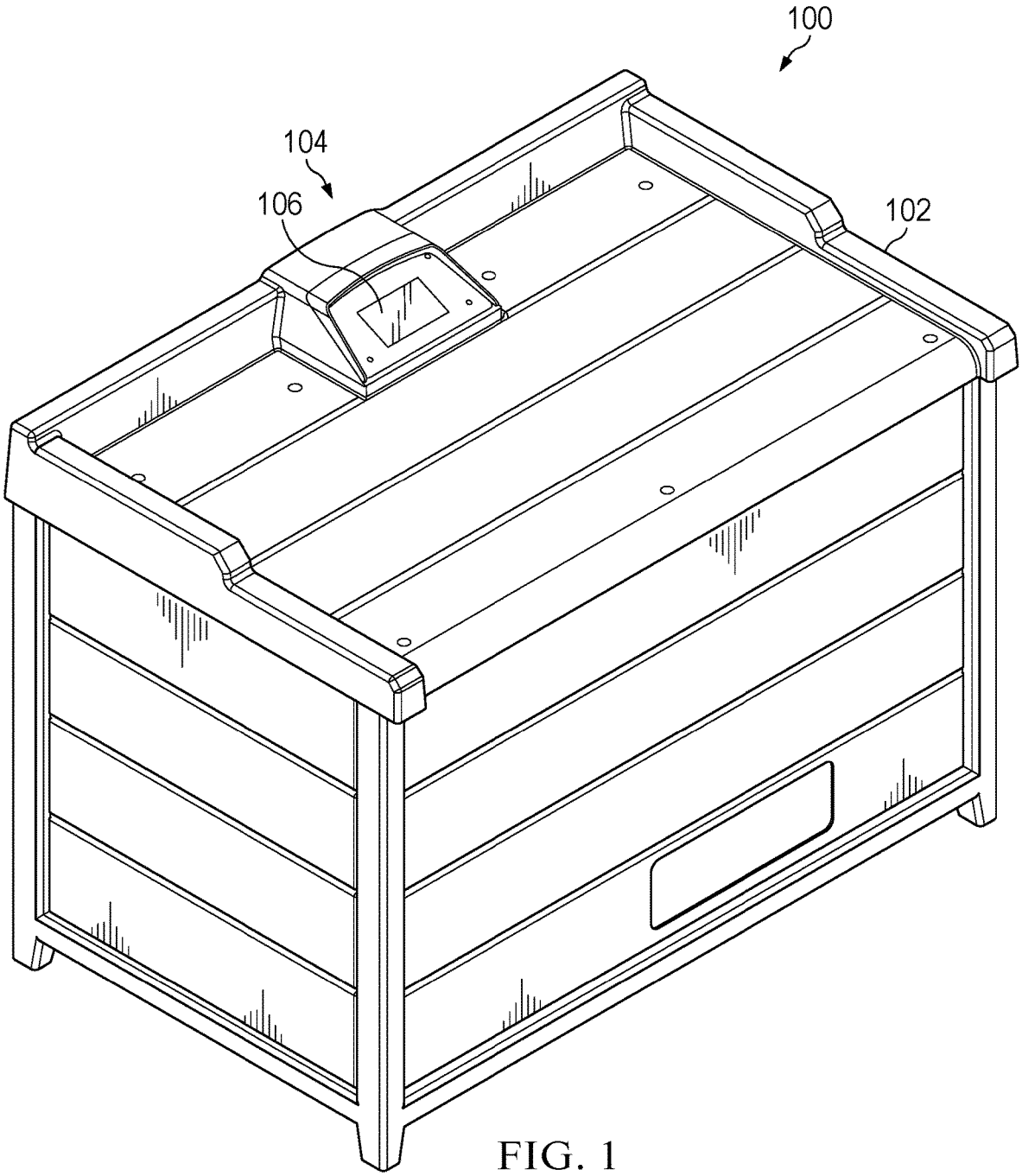
FIG. 1 is a perspective view of an example of a parcel receptacle in accordance with the present disclosure in a closed configuration.

These Figures will be better understood by reference to the following Detailed Description.

DETAILED DESCRIPTION

For the purpose of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more example implementations or figures although those same elements or features may appear in other example implementations or figures without such a high level of detail. It is fully contemplated that the features, components, and/or steps described with respect to one or more example implementations or figures may be combined with the features, components, and/or steps described with respect to other example implementations or figures of the present disclosure. For simplicity, in some instances the same or similar reference numbers are used throughout the drawings to refer to the same or like parts.

The present disclosure is directed to systems and methods for improved parcel delivery. The systems and methods described herein may provide security of delivered parcels and/or reduced delivery times. The concepts of the present disclosure may be suited for homes equipped with parcel receptacles, which may have Wi-Fi and/or other wireless communication capabilities facilitating communication with remote servers and/or driver devices.

Figure 2:
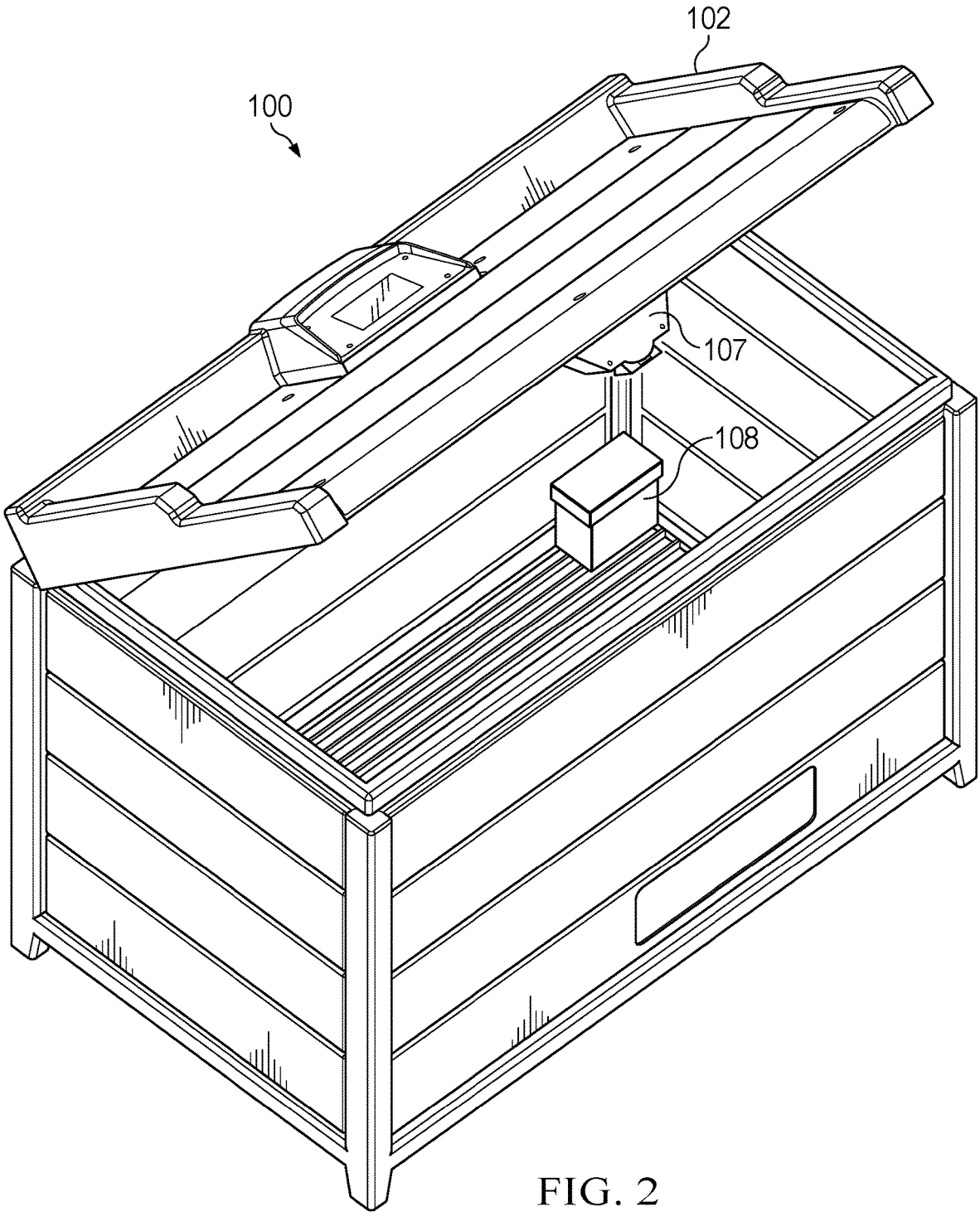
FIG. 2 is a perspective view of the example of a parcel receptacle of FIG. 1 in an open configuration.

FIGS. 1-2 illustrate an example of a parcel receptacle 100 in a closed configuration and an open configuration, respectively. The parcel receptacle 100 includes a lid 102 which is pivotably coupled to housing forming a compartment configured to receive and store parcels. A controller 104 in the form of a control panel is mounted to the lid and is configured to perform a variety of functions related to use of the parcel receptacle 100, as discussed in more detail below. The controller 104 includes a display 106 for displaying information to a user. In some examples, the display 106 is a touchscreen configured to receive user inputs. User inputs may additionally or alternatively be received by a keypad, pushbuttons, or a user interface on a wireless device, for example.

A lock mechanism 107 is secured to the lid 102 and is configured to selectively lock the lid 102 in the closed position, thereby preventing access into the compartment within the parcel receptacle 100. The lock mechanism 107 may include an actuator configured to move a component of the lock mechanism into and out of engagement with a corresponding component in the compartment. A power source 108 in the form of a replaceable or rechargeable battery is shown within the compartment of the parcel receptacle. In some examples, the parcel receptacle 100 may be powered primarily by a battery or may use a battery as a back-up power source to maintain operations of the controller 104 during an interruption of a primary power source (e.g., 120v electrical outlet). Additional details of a parcel receptacle, including a controller and a lock mechanism, are provided in U.S. Pat. App. Pub. No. 2019/0000255 entitled "Receptacle for Receiving and Securing Packages and Other Items" filed Jun. 29, 2018, which is incorporated by reference herein in its entirety.

Figure 3:
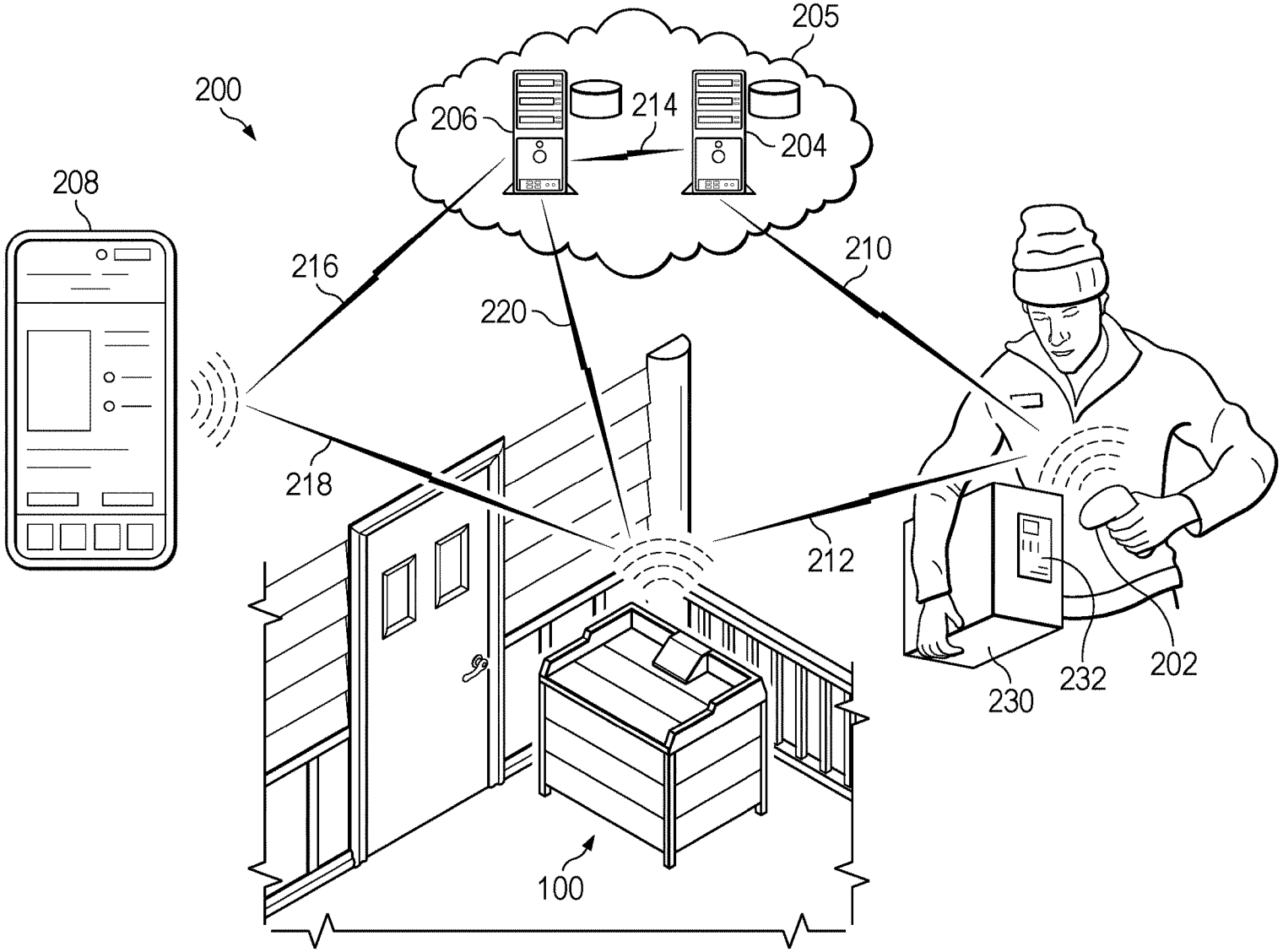
FIG. 3 illustrates an example of a parcel delivery system in accordance with the present disclosure.

FIG. 3 illustrates a parcel delivery system 200 including parcel receptacle 100, a driver device 202, a mobile device 208, a carrier platform 204, and a receptacle platform 206. The various devices may communicate via a plurality of local and remote data communication channels 210, 212, 214, 216, 218, and 220. Locally, a user may be able to control the parcel receptacle 100 (e.g., access permissions and lock mechanism control) via the mobile device 208 and a driver may be able to access the parcel receptacle 100 using the driver device 202. Zebra Technologies Corp. markets devices which may be suitable for use as a driver device 202. Each of the parcel receptacle 100, the driver device 202, and the mobile device 208 may be configured to communicate with remote processing platforms via the internet 205.

The parcel receptacle 100 may be disposed at any suitable commercial or residential location. In the illustrated example, the parcel receptacle is positioned on a front porch of a home. A user may be able to run an application on the mobile device 208 to monitor and control the parcel receptacle 100. For example, a user may be able to add or remove permissions for other users, including carriers and drivers, may be able to lock or unlock the parcel receptacle 100 from a user interface, may receive a notification that a delivery has been completed, etc. The mobile device 208 may communicate with the parcel receptacle 100 via the local data communication channel 218 when within range and may communicate with the receptacle platform 206 via the remote data communication channel 216 which, in turn, communicates with the parcel receptacle 100 via the remote data communication channel 220 using the internet 205 and, typically, the customer's Wi-Fi router. In this regard, a user may be able to control the parcel receptacle 100 via the mobile device 208 even when located remotely from the premises. The receptacle platform 206 may include a receptacle server maintained by a manufacturer of the parcel receptacle 100, a third-party service provider, or another related party.

A driver may have a hand-held delivery driver device 202, discussed in more detail with reference to FIG. 5, that may be configured to scan a label 232 on a parcel 230 to extract or lookup a parcel identifier such as a carrier tracking number. The driver device 202 may utilize a remote data communication channel 210 to transmit a reporting message with information associated with the parcel identifier to a carrier platform 204. The carrier platform 204 may include a server maintained by the carrier and configured for cloud processing of parcel information. The carrier platform 204, in some examples, may be integral with the receptacle platform 206. The remote data communication channel 210 may comprise a cellular data network providing access to the internet 205. Information associated with the parcel identifier that is sent from the driver device 202 to the carrier platform 204 may include one or more of a carrier tracking number, a timestamp related to the delivery of the parcel 230 based on the data and time the label 232 is scanned, GPS coordinates providing confirmation of the driver's location, a name or employee of the delivering driver, a serial number or other identifier of the driver device 202, etc. This reporting message received at the carrier platform 204 may be used for tracking delivery status internally within the carrier, generating a delivery confirmation to be sent to a vendor or other originator of the parcel, generating a delivery confirmation message to be sent to the recipient (e.g., via email), etc. While it is not uncommon for a driver device to transmit a reporting message in response to scanning a parcel label at the time of delivery, in accordance with the present disclosure, the scanning of the parcel label may also cause the driver device to initiate an exchange with the parcel receptacle 100 to obtain access into the parcel receptacle. In this regard, the driver device 202 may have a multi-functional response to scanning of the parcel label 232: 1) automatically transmit a reporting message to the carrier platform 204; and 2) automatically transmit an authentication message to the parcel receptacle 100 to facilitate unlocking.

The driver device 202 may communicate with the parcel receptacle 100 via a local data communication channel 212. The local data communication channel 212 may utilize a low energy transmission method such as low energy Bluetooth which has a communication range of approximately 30 feet and provided direct device to device communication with minimal latency. Any suitable local communications protocol may be used to facilitate the local data communication channel 212, such as an ad hoc Wi-Fi network. While the driver device 202 may be able to communicate with the parcel receptacle 100 indirectly via communication channels 210, 214, and 220, advantageously, the direct device to device communication arrangement using local data communication channel 212 does not require network access by the driver device 202 or the parcel receptacle 100 for exchange of information therebetween. Accordingly, a driver may be able to obtain access into the parcel receptacle 100 even when a sufficient cellular connection cannot be made or when there is a local network outage (e.g., parcel receptacle 100 unable to connect to customer's Wi-Fi router). Further, including a power source 108 that includes a battery as discussed in relation to FIG. 2 may allow the parcel receptacle 100 to continue functioning to grant access to a driver in the event of a power outage.

The carrier platform 204 may send delivery information to the receptacle platform 206 via the data communication channel 214, which may include an application programming interface ("API"). In some examples, such delivery information may be sent each time a new parcel identifier (e.g., tracking number) is generated that is associated with a customer account that has opted-in to a parcel receptacle delivery program. In this regard, only delivery information corresponding to deliveries to parcel receptacles may be sent from the carrier platform 204 to the receptacle platform 206. In some examples, delivery information for all parcels may be provided to the receptacle platform 206 by the carrier platform 204 and the receptacle platform 206 may determine which deliveries are associated with parcel receptacles managed by the receptacle platform 206, which others may be ignored or discarded. In some examples, a user may submit a request for delivery of a specific parcel to the parcel receptacle 100 via a user interface of the mobile device 208 and the receptacle platform 206 may then transmit a message to the carrier platform 204 that the delivery is to be made to parcel receptacle 100 so the delivery can be managed accordingly. For example, a user may receive an email regarding a parcel from the carrier which may include a parcel identifier. The user may enter the parcel identifier into the user interface of the application on the mobile device 208 and indicate that the parcel should be placed in the parcel receptacle 100. The request for delivery to the parcel receptacle may be sent to the carrier platform 204 which may notify the driver device 202 that the package should be placed in the parcel receptacle 100. The driver device 202 may notify the driver that the parcel is to be placed in the parcel receptacle 100 or may automatically send an authentication message to unlock the parcel receptacle as discussed below. In some examples, a user may authorize use of a parcel receptacle via a carrier's website or mobile application. Single or two factor authentication may be used to confirm a user's identity to the carrier. A user may then authorize transmission of parcel identifiers for upcoming deliveries from the carrier platform 204 to the receptacle platform 206. For instance, the user may check a box or provide other authorization to grant the carrier access to use of the parcel receptacle. In some examples, the user may provide a device ID, MAC address, serial number, or other identifier of the parcel receptacle to ensure authentication data is electronically delivered to the correct parcel receptacle. Parcel identifiers may be pushed or pulled between the two platforms 204, 206 periodically or upon entry of new scheduled delivery into the carrier platform. In some examples, all the parcel identifiers for a given parcel receptacle may be aggregated and transmitted in a single transmission. Similarly, all parcel identifiers for all users of a parcel receptacle vendor may be aggregated and sent from the carrier platform 204 to the respective receptacle platform 206. Any number of suitable encryption schemes may be used to add security to the transmissions such as HTTPS. The parcel identifiers for upcoming deliveries may be sent one or more times per day, with or without regard for prior transmission to the receptacle platform. The receptacle platform 206 may recognize and disregard duplicate entries. The transmission of parcel identifiers between the platforms may be made in any suitable format. In some examples, the transmission comprise a series of parcel identifiers delimited or grouped by parcel receptacle identifiers.

In additional to parcel identifiers, information transmitted from a carrier platform 204 to a receptacle platform 206 may include any particular requirements associated with delivery of a parcel. For example, an indicator regarding an indirect or direct signature requirement for a particular parcel may be appended to a parcel identifier for that parcel. For example, the end of each parcel identifier may include an "-I" or "-D" to indicate an indirect or direct signature requirement or an "-N" if no signature is required. This additional information associated with a parcel identifier may indicate to a parcel receptacle and/or driver device that a signature is required during delivery of a parcel. Other information that could be associated with a parcel includes a parcel volume or dimensions in order to alert a user that an oversize parcel may require an alternate delivery location (e.g., garage). Weight could be included so that the user is provided notice that assistance may be required to retrieve the parcel. Temperature requirements could be transmitted to alert the user to place insulation, ice, etc. into the parcel receptacle in advance of delivery. In some examples, a parcel receptacle 100 may have temperature control and information associated with a parcel identifier may permit the appropriate temperature to be set in the parcel receptacle in advance of delivery. An anticipated delivery date or time window may be included in information sent with parcel identifiers from the carrier platform 204 to the receptacle platform 206.

Figure 4:
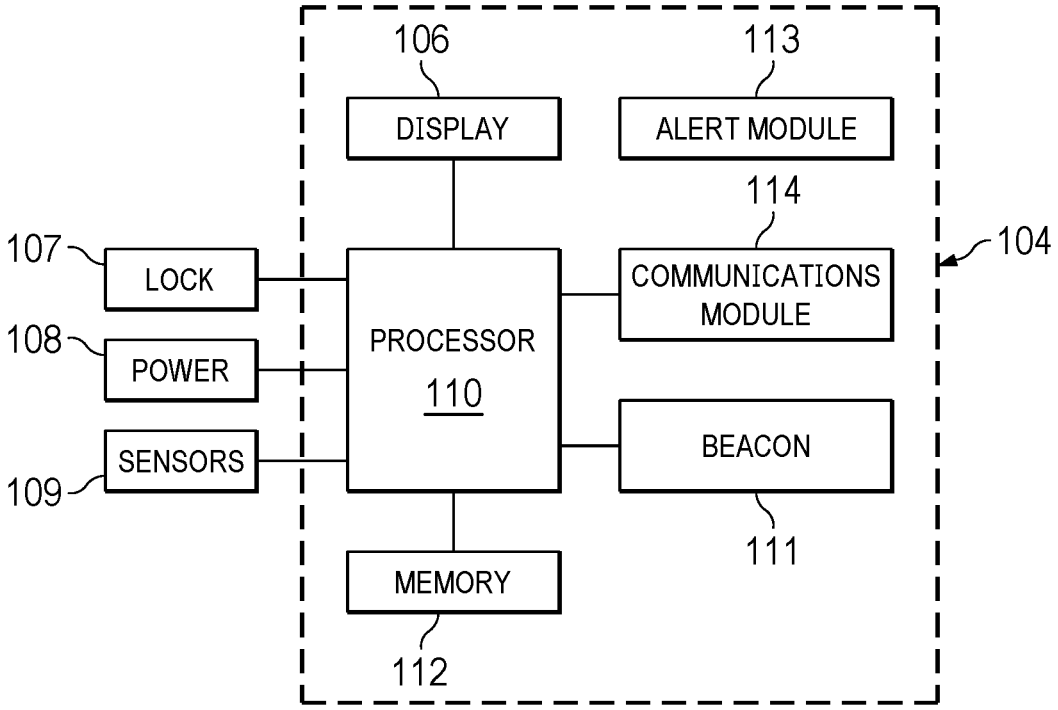
FIG. 4 is a schematic illustration of an example of a parcel receptacle in accordance with the present disclosure.
Figure 5:
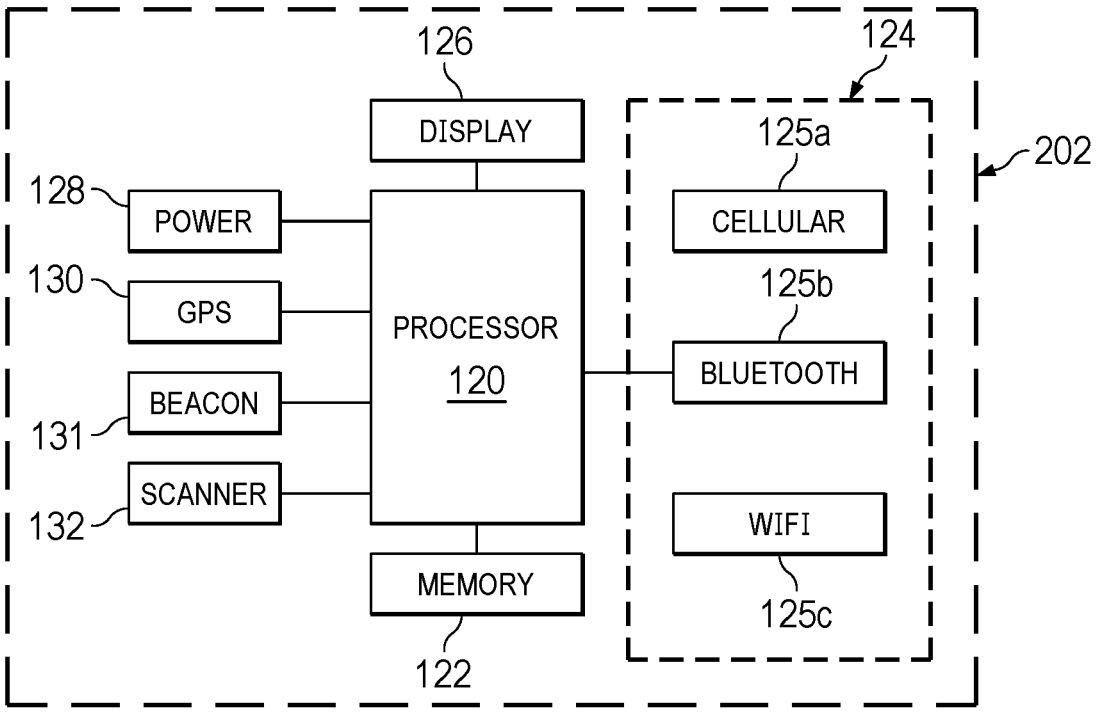
FIG. 5 is a schematic illustration of an example of a driver device in accordance with the present disclosure.

FIGS. 4 and 5 schematically illustrate components of the parcel receptacle 100 and of the driver device 202, respectively, which aid in understanding the functions of the parcel delivery system 200. With reference to FIG. 4, the parcel receptacle 100 may include a controller 104, a lock mechanism 107, a power source 108, and one or more sensors 109. The controller 104 of the parcel receptacle 100 includes a display 106, a processor 110, memory 112, a beacon 111, an alert module 113, and a communications module 114. The processor 110 is in operative communication with each of the other components of the controller 104 and is also in operative communication with other components of the parcel receptacle 100 outside the controller 104 such as the lock mechanism 107, the power source 108, and one or more sensors 109. The display 106 may display information to a user such as a current status of the parcel receptacle 100 (e.g., locked/unlocked, battery life, etc.), display instructions to a driver (e.g., "Enter Access Code"), and/or may receive user inputs (e.g., an access code or a menu item selection). Memory 112 may store instructions for operation of the various functions of the parcel receptacle 100 by the controller 104.

Memory 112 may also store one or more lists of parcel identifiers. For example, an "active code list" may be maintained by the processor 110 in memory 112 with parcel identifiers for one or more expected deliveries. The codes in the active code list may be parcel identifiers themselves or any unique code allowing the parcel receptacle 100 to distinguish an authorized access request from an unauthorized access request. In some examples, the codes in the active code list may include authorized carrier identifiers associated with particular carriers granted permission to access the parcel receptacle for any and all deliveries or authorized driver device identifiers associated with particular driver devices. The codes may be added to the active code list manually by a user entering a code in a user interface of the mobile device 208 or via a user interface of the controller 104 itself. A code in the active code list may also be added automatically, for example, by the receptacle platform 206 transmitting an identifier (e.g., parcel identifier, carrier identifier, and/or driver device identifier, etc.) to the controller 104. In some examples, the receptacle platform 206 may be granted user permission to parse a user's email messages and extract parcel identifiers from messages to add them to the active code list. In this regard, the active code list may include a listing of unique identifiers that may be used to grant access permission into the compartment of the parcel receptacle 100.

The alert module 113 may include a speaker and/or a light that can be activated to alert a user of one or more conditions. For example, drivers are typically in a habit of placing parcels on a recipient's porch and oftentimes do not look for or notice that a parcel receptacle is available. When a parcel receptacle is not utilized, deliveries may be unsecure and vulnerable to theft. In this regard, alert module 113 may emit a sound, verbal instruction, or flashing light to draw a driver's attention to the availability of the parcel receptacle 100. As a further example, even when a driver notices the presence of a parcel receptacle, they may not know whether the particular parcel they are delivering should be placed in the parcel receptacle, how to access the parcel receptacle, or whether their request to access the parcel receptacle has been granted or denied. In this regard, the alert module 113 may communicate such information to a driver.

The communications module 114 may include one or more transmitters, antennas, transceivers, receivers, etc. to facilitate wireless communication with external devices including, but not limited to, a mobile device (e.g., mobile device 208), a customer's router, or a driver device (e.g., driver device 202). The communications module 114 may be configured for communication using one or more of a Wi-Fi protocol, a cellular protocol, a Bluetooth protocol, etc.

Beacon 111 may be configured to continuously or periodically broadcast an unsolicited beacon signal. The beacon signal may simply include a notice that a parcel receptacle is present. In some examples, the beacon signal may include a unique identifier such as a customer identifier associated with the owner of the parcel receptacle 100 or a serial number or other unique receptacle identifier. The beacon signal may be received by a driver device within the transmission range of the beacon 111 to prompt the driver device to initiate an authentication process with the parcel receptacle. In some examples, the beacon 111 need not be a separate and distinct component but rather the communications module 114 may be operated in a manner consistent with a beacon to transmit a beacon signal.

The one or more sensors 109 may include a number of different types of sensors configured to transmit signals to the processor 110. In some examples, sensors 109 may include one or more sensors configured to detect the presence of a parcel. For example, a force sensor may be disposed on a floor of the compartment of the parcel receptacle to detect the weight of a parcel. An optical sensor may be configured to detect an obstruction in a beam, such as a laser, extending across a portion of the compartment in the parcel receptacle. The obstruction may be interpreted by the controller 104 as indicating that a parcel has been placed in the parcel receptacle. Similarly, a light curtain sensor may extend across a plane near the lid of the parcel receptacle such that any object entering the compartment must break the plane and trigger the sensor indicating that a parcel has been received. Although a parcel presence sensor may be positioned at any location within the parcel receptacle, different positions may provide different advantages and/or disadvantages. For example, an optical sensor extending across a bottom portion of the compartment of the parcel receptacle may indicate the presence of a parcel regardless of its size or weight, but may have difficulty detecting an additional parcel stacked on top of the original parcel. An optical sensor extending across a top portion of the compartment of the parcel receptacle may indicate the presence of a parcel as it is placed into the compartment, but may have difficulty distinguishing between a parcel being removed from the compartment or a parcel being inserted into the compartment. In this regard, it may be desirable to include a plurality of sensors that may collectively facilitate a greater degree of discerning between presence, size, weight, etc.

Further, sensors 109 may include sensors that are not directly related to detecting the presence of a parcel. For example, a lock mechanism actuation sensor may be configured to monitor a portion of a lock mechanism (e.g., lock mechanism 107) such that the controller 104 can determine whether the lock mechanism is in a locked configuration or a closed configuration. Similarly, sensors 109 may include one or more sensors configured to monitor a position of the lid to determine whether the lid is open or closed.

It should be appreciated that FIG. 4 illustrates one example of a parcel receptacle 100. It is contemplated that additional components may be included and some of the enumerated components may be omitted without departing from the scope of this disclosure. For example, a simplified example of a parcel receptacle may include a controller 104 with a processor 110, memory 112, and a communications module 114 providing only local communication (e.g., Bluetooth), as well as a lock mechanism 107 and a power source 108. One or more of the display 106, sensors 109, alert module 113, and beacon 111 may be omitted.

Turning to FIG. 5, the driver device 202 includes a number of components that are similar to those of the parcel receptacle such as a processor 120, memory 122, display 126, communications module 124, power source 128, and beacon 131, as well as some additional components such as a global positioning system ("GPS") module 130 and a scanner 132. Memory 122 may store delivery information for a batch of parcels, such as the parcels currently loaded in the driver's truck. The stored delivery information may include delivery addresses, parcel identifiers of the parcels associated with each address, delivery instructions such as: whether a signature is required, what types of signature are acceptable, whether a parcel receptacle is available, etc. The delivery information may be organized by address such that all parcels delivered to a particular address are associated with an instruction to place the parcels in a parcel receptacle or may be organized by parcel identifiers (e.g., tracking numbers) such that certain parcels are associated with instructions to use a parcel receptacle while other parcels for the same address are to be placed outside the parcel receptacle (thereby saving space within the parcel receptacle for future deliveries).

Memory 122 may also store navigational guidance instructions. For example, the processor 120 may receive GPS data from the GPS module 130 and route the driver to each delivery stop with a map and/or turn-by-turn instructions on the display 126.

Communications module 124 may include one or more transmitters, antennas, transceivers, receivers, etc. to facilitate wireless communication with external devices. In the illustrated example, the communications module 124 includes a cellular module 125*a*, a Bluetooth module 125*b*, and a Wi-Fi module 125*c*. Each of these modules 125 may include separate transmission and reception hardware, may include software or firmware for execution of different protocols via shared hardware, or a combination of both. The cellular module 125*a* may be used for transmission of reporting messages to the carrier platform. The Bluetooth module 125*b* may be used for communication with a parcel receptacle. The Wi-Fi module 125*c* may be used for communication with a parcel receptacle, either directly or indirectly (e.g., through the carrier platform and receptacle platform or through a customer's Wi-Fi router). It should be appreciated that the communications module 114 of the parcel receptacle 100 may be substantially similar to the communications module 124 of the driver device 202.

The display 126 may display a variety of information to a driver. For example, upon reaching a delivery stop, a user interface on the display 126 may indicate a total number of parcels to be delivered at the address, parcel identifiers of the parcels, whether a parcel receptacle is associated with the address, etc. The display 126 upon establishing communication with a parcel receptacle may display information associated with the parcel receptacle such as a specific location within the premises where the parcel receptacle can be located, a current status of a parcel receptacle (e.g., locked/unlocked), etc. The display 126 may also be configured to receive driver inputs (e.g., an access code for unlocking a parcel receptacle or a menu item selection).

Beacon 131 may be configured to continuously or periodically broadcast an unsolicited beacon signal. The beacon signal may simply include a notice that a driver device is present. In some examples, the beacon signal may include a unique identifier such as a carrier identifier, a driver device identifier (e.g., a serial number) etc. The beacon signal may be received by a parcel receptacle within the transmission range of the beacon 131 to prompt the parcel receptacle to initiate an authentication process with the driver device. In some examples, the beacon 131 need not be a separate and distinct component but rather the communications module 124 may be operated in a manner consistent with a beacon to transmit a beacon signal.

The scanner 132 of the driver device 202 may be any sensor suitable for extracting information from a parcel. Because parcel labels typically include a barcode (e.g., a one-dimensional barcode, a matrix barcode such as a quick response ("QR") code, or similar), the scanner 132 may be an optical scanner configured to interpret ("read" or "decode") such parcel label codes. In some examples, the scanner 132 may be a laser scanner. In some examples, the scanner 132 may be a camera. In some examples, the scanner 132 may be a type of sensor other than an optical sensor. For example, a radio-frequency identification scanner may be used to detect and read RFID chips or other near-field communication ("NFC") tags secured to parcels.

It should be appreciated that FIG. 5 illustrates one example of a driver device 202. It is contemplated that additional components may be included and some of the enumerated components may be omitted without departing from the scope of this disclosure. For example, a simplified example of a driver device 202 may include a processor 120, memory 122, and a communications module 124 providing only local communication (e.g., Bluetooth module 125*b*), as well as a scanner 132 (or other sensor) and a power source 108. One or more of the display 126, GPS module 130, or beacon 131 may be omitted.

Figure 6:
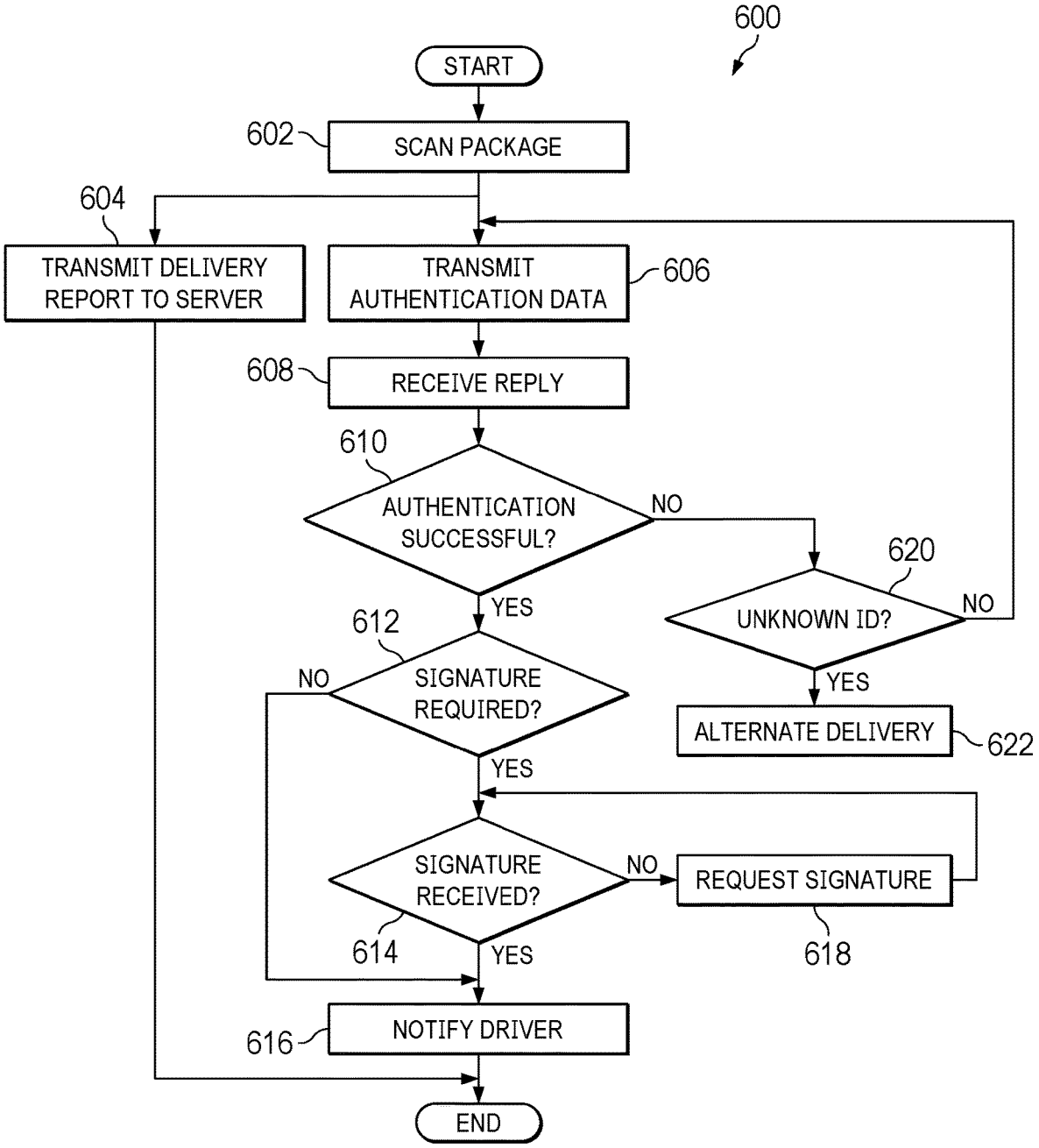
FIG. 6 is a flowchart of an example of a method of authenticating delivery of a parcel performed on a driver device.

FIG. 6 is a flowchart of an example of a method 600 of authenticating delivery of a parcel performed on a driver device. At process 602, a parcel is scanned by a scanner of a driver device. At process 604, a delivery report is generated and transmitted to a carrier server of the carrier platform. The delivery report may include any suitable information such as the parcel identifier (e.g., tracking number), GPS location data, date and time of delivery, name of delivery driver, etc. The delivery report may be transmitted by any suitable data communication channel such as a cellular data connection to the internet.

At process 606, an authentication message is generated and transmitted to a parcel receptacle. The authentication message may include any suitable authentication data for establishing access permission into the compartment of the parcel receptacle. In some examples, the authentication data includes a parcel identifier (e.g., tracking number). The authentication message may be transmitted by any suitable data communication channel such as Bluetooth. In some examples, processes 604 and 606 occur automatically in response to the parcel label being scanned and the parcel identifier received at the process of the driver device. In some examples, process 604 may be performed in response to a driver input while process 606 is performed automatically. In this regard, process 606 may occur without causing delay to the driver. In some instances, a driver may be making a delivery that is out of range of a cellular network or in an area with reduced service causing latency. The method 600 may continue regardless by delaying transmission of the reporting message or reattempting transmission of the reporting message and it is successful (e.g., acknowledgement received from carrier platform). Such latency does not delay the driver from proceeding with the delivery as local communication with the parcel receptacle may be uninterrupted. The generation and transmission of the authentication message at process 606 eliminates the need for the driver to scan the package with another device, enter a code into a user interface of the parcel receptacle, or perform some other action for gaining access into the compartment and, therefore, may cause no or minimal delay to the driver.

At process 608, a reply is received from the parcel receptacle. At process 610, in the event the reply is an error message indicating the authentication message was not accepted by the parcel receptacle (e.g., authentication failed and the parcel receptacle will remain locked), at process 620 it may be determined whether the error message indicates that the parcel identifier was unknown or unrecognized by the parcel receptacle. If the error was not an unknown or unrecognized parcel identifier, the method may return to process 606 and retransmit the authentication message. If the error message indicates the parcel identifier is unknown or unrecognized, at process 622, the driver device may provide the driver instructions to execute an alternative delivery method (e.g., leave on porch, return to truck, etc.).

If the reply message received at process 608 is an acknowledgement message indicating that authentication was successful at process 610, the method may proceed to process 612 to determine whether a signature requirement is associated with the parcel identifier. If no signature requirements are identified, at process 616, a notification may be provided to the driver that the parcel may be placed in the parcel receptacle to complete delivery. For example, a display of the driver device may display a notification message or an audible tone from the driver device may indicate that delivery may process. However, if it is determined at process 612 that a signature requirement is associated with the parcel identifier, at process 614 it is determined whether the signature information has already been received or the signature requirement has been satisfied otherwise. In some examples, a user may be able to satisfy the signature requirement by logging into a mobile application or website of the receptacle platform or the carrier platform in advance of the delivery and submitting an indication that the user accepts responsibility of the parcel upon delivery into the parcel receptacle. The driver device at process 614 may determine if such an indication has been provided. If the signature requirement has been satisfied, the method may continue to process 616 so the driver may complete the delivery. If a signature is required and the signature has not yet been received, at process 618 the signature may be requested and the method may return to process 614. In some examples, the signature may be requested by transmitting a signature request message to the parcel receptacle prompting return of a signature message. Alternatively, a message may be displayed on the driver device instructing the driver to obtain a signature. In some examples, the driver may retrieve a physical signature from within the parcel receptacle. In some examples, the driver may be prompted to capture a photo of a signature displayed on the parcel receptacle. Depending on requirements imposed by particular vendors, carriers, customers, and local laws and regulations, it is contemplated that in some examples, the process of authenticating a delivery and confirming that the parcel receptacle has been locked may satisfy signature requirements for a delivery without the need for separate processes 612-618. Similarly, a driver may be prompted to capture a picture of the parcel inside the parcel receptacle or to scan a barcode positioned inside the parcel receptacle to confirm the driver did, in fact, access the parcel receptacle.

It should be appreciated that in some instances, scanning the parcel label at process 602 may be the only manual interaction by the driver required. If authentication is successful and either a signature is not required or a signature is received successfully, processes 604-620 may be performed by the driver device without driver input.

It should be further appreciated that one or more of the processes of method 600 may be omitted in some examples. In one particular example, the method 600 may include only processes 600-604. For example, some parcel receptacles may not be configured for two-way communication with any driver devices or with a particular make and model of driver device. However, the driver device may still be configured to transmit an authentication message to the parcel receptacle to unlock it. It is contemplated that the driver device may automatically transmit an authentication message multiple times to increase the likelihood of successful receipt by the parcel receptacle.

Figure 7:
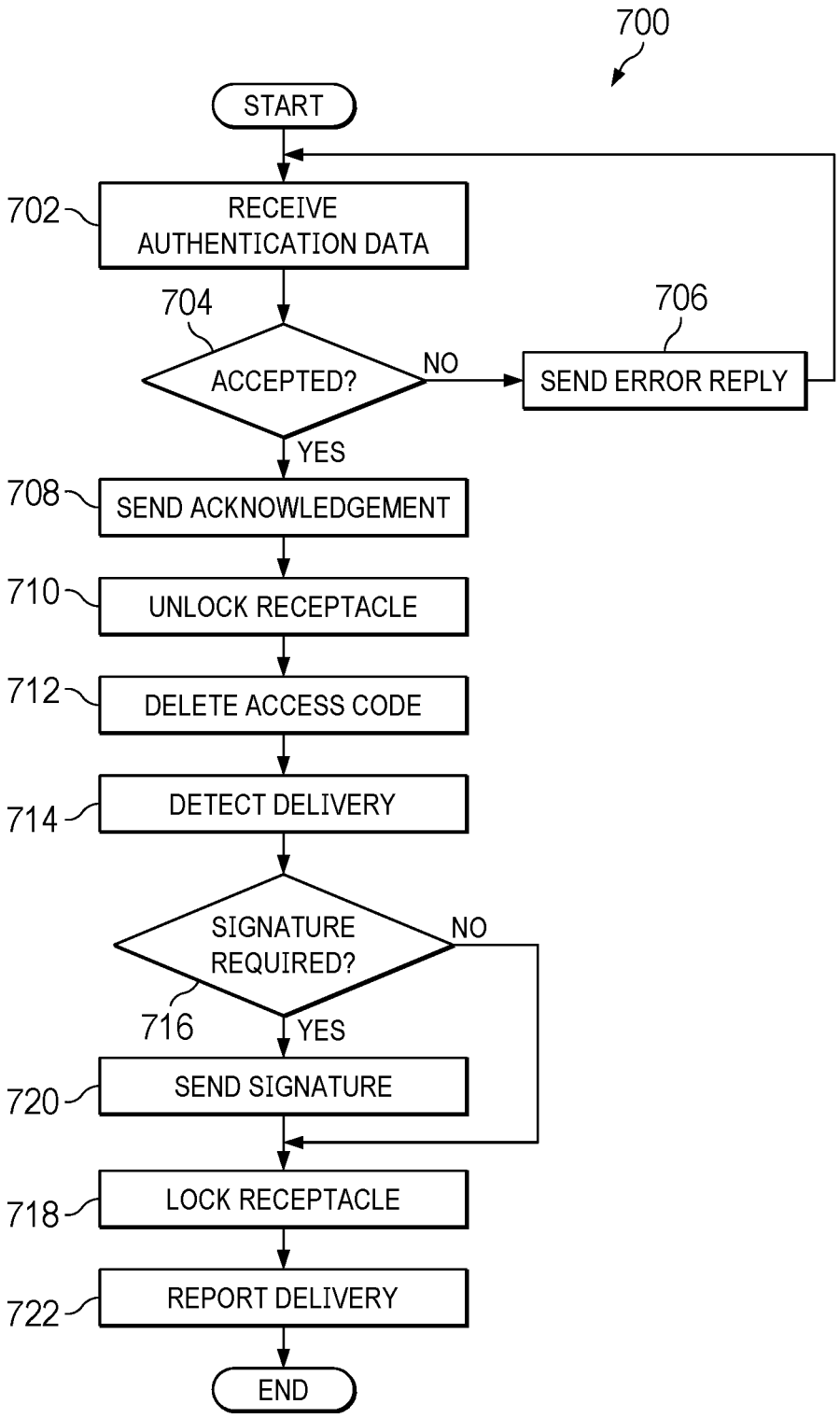
FIG. 7 is a flowchart of an example of a method of authenticating delivery of a parcel performed on a parcel receptacle.

FIG. 7 is a flowchart of an example of a method 700 of authenticating delivery of a parcel performed on a parcel receptacle. At process 702, the parcel receptacle may receive an authentication message from a driver device. The authentication message may include one or more parcel identifiers associated with the delivery, a carrier identifier, a driver identifier, or a driver device identifier. At process 704, the parcel receptacle may compare the one or more received identifiers to an active list of acceptable codes. The list may include parcel identifiers of anticipated deliveries, approved carrier identifiers (e.g., USPS may be permitted to access the parcel receptacle but a local grocery store may not be permitted), approved driver identifiers, and/or approved driver device identifiers. One or more of the acceptable codes may be required in order to authenticate. In some examples, a received authentication message may simply comprise a single parcel identifier. In some examples, a received authentication message may not be approved by the parcel receptacle unless it contains an acceptable parcel identifier and an acceptable carrier identifier or an acceptable driver device identifier. The acceptable codes in the active code list may be stored in memory of the controller of the parcel receptacle. In some examples, one or more acceptable codes may be manually input by a user at the controller, manually sent to the controller from a user's mobile device, or automatically added to the controller by a receptacle platform either upon receipt from a carrier platform or by crawling a user's email account to identify anticipated deliveries and parse parcel identifiers.

If the authentication message received at process 702 does not contain an acceptable code, or a plurality of acceptable codes if required, the parcel receptacle may simply take no further action. In some examples, the parcel receptacle 706 may send a reply including an error message. The controller of the parcel receptacle may additionally or alternatively instruct an alert module to generate an alert or instruct the display to display a message indicating that the authentication message failed authentication.

At process 708, if authentication is successful, an acknowledgement message may be sent. Additionally or alternatively, the alert module may be used to generate a visual or audible indication that authentication was successful or a message may be displayed on the display of the parcel receptacle.

In response to successful authentication, at process 710 the controller of the parcel receptacle may unlock the lock mechanism, allowing access into the compartment. In some examples, the acceptable code(s) identified in the authentication message may be removed from the active code list at process 712. Removal of the code may prevent a bad actor from capturing the authentication message during initial transmission and spoofing the message after the driver has left. While any suitable parcel identifier or other access codes are contemplated for use in authentication messages, tracking numbers may be particularly suitable. Tracking numbers have some degree of inherent secrecy as they are generally unique and do not reveal personal information. Tracking numbers are only used by a carrier one time, or at least not repeated for a long period of time. In this regard, rather than simply deleting a used parcel identifier from memory altogether, the controller may move it to an inactive code list for monitoring. If the identifier is presented in a subsequent authentication message after delivery has occurred, it may be assumed to be an attempt to gain unauthorized access into the parcel receptacle. A notification may be sent to the user's mobile device (directly and/or remotely through the receptacle platform) that an invalid second attempt was made to access the parcel receptacle.

At process 714, which may occur before or after removing the code from the active code list, the parcel receptacle may detect delivery of one or more parcels. In some examples, delivery may be assumed based on an elapsed period of time which should be sufficient for delivery to have occurred. In some examples, receipt of a driver input on the controller of the parcel receptacle may indicate delivery has occurred. For example, a message may be presented to the driver on the display requesting confirmation of delivery by pressing a button. Alternatively, the driver may press a "Lock" button on the controller to actuate the lock mechanism. In some examples, one or more sensors of the parcel receptacle may detect that delivery has occurred based on opening and closing of the lid or obstruction of an optical sensor, for example.

At process 716, it is determined whether a signature requirement is associated with the parcel identifier of one or more of the delivered parcels. If not, the method may proceed to process 718 to lock the parcel receptacle. If a signature requirement is determined, at process 720, the parcel receptacle may transmit an electronic signature message to the driver device. The signature message may include an indication that the user has agreed to a waiver of liability for receipt of the parcel without being present. In some examples, the process 720 may include displaying the user's signature on a display of the parcel receptacle, with or without a parcel identifier, a timestamp, confirmation of age, a photo of the user, or other information that may be suitable for satisfaction of a signature requirement. The driver may capture a photo of the display using the driver device. In some examples, a user may physically sign a waiver and place it into the compartment in advance of delivery. The waiver may be generic or may include specific details about the parcel for which liability is being waived. In such examples, at process 720, a message may be displayed on the display or an alert may be provided by the alert module of the parcel receptacle to alert the driver that a waiver should be retrieved from the compartment.

Upon satisfaction of the signature requirement, if it is determined that there is one, the controller instructs the lock mechanism to lock the parcel receptacle at process 718. At process 722, the parcel receptacle may send a report or otherwise notify a user that a delivery has been completed. The report may include any relevant information about the delivery such as the parcel identifier, a vendor associated with the parcel identifier (e.g., store name), driver identifier, date/time of delivery, confirmation of lock status, etc.

It should be appreciated that one or more of the processes of method 700 may be omitted in some examples. In one particular example, the method 700 may include only processes 702, 704, and 710. For example, a simple parcel receptacle may receive an authentication message, determine it is acceptable by comparing a parcel identifier to a list of acceptable codes, and unlock that lid in response. Following delivery, the driver may press a lock button or the controller may automatically lock the lid after a period of time has elapsed.

Additional functions may also be added to the method 700. For example, a parcel receptacle may typically be configured for access by any member of a household by presenting appropriate credentials such as an access code typed into the controller or a message sent from a user's mobile device. It is contemplated that each unique user in the household may have a distinct user identifier. Subject to local laws and regulations, it is contemplated that a parcel receptacle may use these unique user identifiers to provide selective access into the parcel receptacle for retrieval of particular parcels. For example, medication or alcohol deliveries may be associated with a parcel identifier having a restricted access requirement. For these restricted items, the controller of the parcel receptacle can be configured to unlock the lid only upon entry of a user identifier associated with a particular user or users legally permitted to access the contents. Accordingly, the method 700 may further include a process for determining if a retrieval access restriction is associated with a parcel that has been delivered and to validate retrieval only for permitted users.

Further, one or both of methods 600 and 700 may include a process of transmitting or receiving a beacon signal for initiation of the respective method. For example, rather than scanning a package to initiate transmission of authentication data from a driver device to a parcel receptacle, the method 600 may omit processes 602 and 604 and instead detect a beacon signal prior to process 606. In some examples, the beacon signal may be a generic indicator that a parcel receptacle is in the vicinity and the driver device may respond to the beacon signal by sending a parcel identifier of any parcel associated with the current delivery, either based on the next parcel in the driver's delivery queue as tracked by software on the driver device or based on a current location using GPS, for example. In some examples, the beacon signal may include a receptacle identifier or user identifier and the driver device may retrieve and transmit a parcel identifier associated with the parcel receptacle. It is contemplated that rather transmitting a beacon signal from the parcel receptacle, the driver device may be configured to transmit a beacon signal. In this regard, the driver may perform deliveries without spending time considering whether they must look for a parcel receptacle at each deliver stop. When the driver approaches a premises with a parcel receptacle, the beacon signal from the driver device may be received by the parcel receptacle which, in turn, sends a reply message to the driver device requesting that an authentication message be sent.

The systems and methods described herein may provide a multi-functional response to scanning of a package label with a driver device, simultaneously prompting transmission of delivery data to a remote carrier platform and transmission of an authentication message to a parcel receptacle.

Although the examples herein are described primarily in the context of a parcel delivered by a carrier to a parcel receptacle, it should be appreciated that the concepts of the present disclosure may be similarly applicable to facilitate expedited deliveries of other articles such as restaurant food orders and groceries. For example, deliverers for companies such as DoorDash, GrubHub, Instacart, and others, may also be considered "drivers" as that term is used herein. These non-carrier drivers also typically use a handheld device such as a smart phone or tablet running an application with a user interface to provide navigational guidance, to confirm delivery, and to capture images of delivered articles. These devices may also be considered "driver devices" or "mobile devices" as those terms are used herein. The systems and methods described herein may improve security of delivered orders by these non-carrier drivers.

Furthermore, the systems and methods described herein are not limited to the examples of parcel receptacles described herein. Improved delivery efficiency and security may be provided by implementing the examples herein with porch containers, garages, vestibules, sheds, gated areas, camera monitored areas, front doors, storage lockers, and the like. For example, some retailers utilize package pick-up kiosks with lockable compartments to store ordered articles for later retrieval by a customer. The concepts herein may be utilized to expedite deliverer placement of articles into particular compartments within such kiosks via their driver device and/or retrieval of articles by purchasers via their smartphone.

Security protocols exist for authentication of users and/or encryption of messages, often using hashed algorithms with shared and hidden keys or public/private keys. These keys and associated certificates must be managed by a trust authority and the infrastructure surrounding these techniques may be ill-equipped to effectively handle a large volume of authentication processes, such as those that may be associated with parcel deliveries. In accordance with the concepts of the present disclosure, identifiers such as a tracking number, order number, or other parcel-related information may be used for access authentication to parcel receptacles. Such identifiers typically have unique features allowing them to be used in granting access to a parcel receptacle in a relatively secure manner. For example, tracking numbers are configured for one-time use, contain a large quantity of characters making them less prone to discovery by brute force, promote privacy in that they do not reveal parcel contents or a name or address of a recipient, and are not publicly published.

Although the figures show relative positions of each component, the actual dimension and scale of each component may differ from the illustration and depend on particular production specifications.

Additional components may be used in the parcel delivery system 200 which are not illustrated or described with specificity to avoid obfuscating the present disclosure.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose.

In addition, the foregoing describes only some examples of the concepts of the present disclosure, and alterations, modifications, additions and/or changes can be made thereto without departing from the scope and spirit of the disclosure, the examples being illustrative and not restrictive.

Also, the various examples described above may be implemented in conjunction with other examples, e.g., aspects of one example may be combined with aspects of another example to realize yet other examples. Further, each independent feature, component, or process of any given system or method may constitute an additional example.

Persons of ordinary skill in the art will appreciate that the implementations encompassed by the present disclosure are not limited to the particular example implementations described above. In that regard, although illustrative examples have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A method, comprising:

receiving an authentication message transmitted wirelessly from a delivery driver device, the authentication message including information associated with a parcel identifier;

comparing the information associated with the parcel identifier to one or more stored codes in an active code list;

sending, in response to determining the information associated with the parcel identifier matches at least one of the one or more stored codes, an unlock instruction signal to a lock mechanism; and wirelessly transmitting an acknowledgement message to the delivery driver device in response to determining the information associated with the parcel identifier matches at least one of the one or more stored codes.

2. The method of claim 1, further comprising:

wirelessly transmitting an error message in response to determining the information associated with the parcel identifier does not match at least one of the one or more stored codes.

3. The method of claim 1, further comprising:

removing the one or more stored codes from the active code list based on determining the information associated with the parcel identifier matches at least one of the one or more stored codes.

4. The method of claim 1, further comprising:

determining a signature requirement is associated with the parcel identifier; and wirelessly transmitting a signature message.

5. The method of claim 4, wherein determining the signature requirement is associated with the parcel identifier comprises receiving a signature request message.

6. The method of claim 1, further comprising:

detecting completion of delivery of a parcel; and sending, in response to the detecting, a lock instruction signal to the lock mechanism.

7. The method of claim 6, further comprising:

detecting a lid of a parcel receptacle has been closed, wherein the detecting the completion of the delivery of the parcel is based at least in part on detecting the lid has been closed.

8. The method of claim 6, wherein the detecting the completion of the delivery of the parcel is based on signals received from one or more sensors disposed within a compartment of a parcel receptacle.

9. The method of claim 1, further comprising:

transmitting a delivery reporting message configured to notify a user that a parcel associated with the parcel identifier has been delivered.

10. A parcel receptacle, comprising:

a compartment;

a lid having a closed position preventing access into the compartment and an open position;

a lock mechanism configured to selectively secure the lid in the closed position;

a wireless communication module; and a controller, the controller being configured to:

receive an authentication message from a delivery driver device via the wireless communication module, the authentication message including a parcel identifier;

compare the parcel identifier to one or more stored codes in an active code list;

send an unlock instruction signal to the lock mechanism in response to determining the parcel identifier matches at least one of the one or more stored codes; and instruct the wireless communication module to transmit an error message to the delivery driver device in response to determining the parcel identifier does not match at least one of the one or more stored codes.

11. The parcel receptacle of claim 10, wherein the controller is further configured to:

instruct the wireless communication module to transmit an acknowledgement message in response to determining the parcel identifier matches at least one of the one or more stored codes.

12. The parcel receptacle of claim 10, wherein the controller is further configured to:

remove the one or more stored codes from the active code list based on determining the parcel identifier matches at least one of the one or more stored codes.

13. The parcel receptacle of claim 10, wherein the controller is further configured to:

determine a signature requirement is associated with the parcel identifier; and instruct the wireless communication module to transmit a signature message.

14. The parcel receptacle of claim 13, wherein determining a signature requirement is associated with the parcel identifier comprises receiving a signature request message.

15. The parcel receptacle of claim 10, wherein the controller is further configured to:

detect completion of delivery of a parcel; and send, in response to the detecting, a lock instruction signal to the lock mechanism.

16. The parcel receptacle of claim 15, wherein the controller is further configured to:

detect the lid has been closed, wherein the detecting the completion of the delivery of the parcel is based at least in part on detecting the lid has been closed.

17. The parcel receptacle of claim 15, further comprising:

one or more sensors disposed in the compartment, wherein the detecting the completion of the delivery of the parcel is based on signals received from the one or more sensors.

18. The parcel receptacle of claim 17, wherein the one or more sensors comprise at least one of a force sensor disposed on a floor of the compartment, an optical sensor, a light curtain sensor, or a lock mechanism actuation sensor.

19. A parcel receptacle, comprising:

a compartment;

a lid having a closed position preventing access into the compartment and an open position;

a lock mechanism configured to selectively secure the lid in the closed position;

a wireless communication module; and a controller, the controller being configured to:

instruct the wireless communication module to periodically transmit a beacon signal comprising a customer identifier associated with the parcel receptacle;

receive an authentication message from a delivery driver device, the authentication message including a parcel identifier;

compare the parcel identifier to one or more stored codes in an active code list; and send an unlock instruction signal to the lock mechanism in response to determining the parcel identifier matches at least one of the one or more stored codes.

20. A parcel receptacle, comprising:

a compartment;

a lid having a closed position preventing access into the compartment and an open position;

a lock mechanism configured to selectively secure the lid in the closed position;

a wireless communication module; and a controller, the controller being configured to:

receive a beacon signal received at the wireless communication module from a delivery driver device;

instruct the wireless communication module to transmit a customer identifier to the delivery driver device in response to receipt of the beacon signal;

receive an authentication message from the delivery driver device, the authentication message including a parcel identifier;

compare the parcel identifier to one or more stored codes in an active code list; and send an unlock instruction signal to the lock mechanism in response to determining the parcel identifier matches at least one of the one or more stored codes.

* * * * *